United States Patent [19]

Fujisawa et al.

[11] 4,353,297

[45] Oct. 12, 1982

[54] NUMBER PRINTING MACHINE FOR OFFSET PRESS

[75] Inventors: Nobuhiko Fujisawa, Fukuyama; Yoshinori Honkawa, Fuchu, both of Japan

[73] Assignee: Ryobi, Limited, Hiroshima, Japan

[21] Appl. No.: 250,377

[22] Filed: Apr. 2, 1981

[30] Foreign Application Priority Data

Apr. 7, 1980 [JP] Japan ..... 55-47489[U]

[51] Int. Cl.[3] ..... B41L 49/02; B41F 7/06; B41F 13/28

[52] U.S. Cl. ..... 101/77; 101/144; 101/234

[58] Field of Search ..... 101/91, 92, 76, 77, 101/85, 86, 87–89, 74, 75, 217, 218, 142, 144, 145, 233, 234

[56] References Cited

U.S. PATENT DOCUMENTS

| | | | |
|---|---|---|---|
| 3,377,948 | 4/1968 | Giori | 101/76 |
| 3,611,921 | 10/1971 | Jahn | 101/77 |
| 4,024,812 | 5/1977 | Jahn | 101/76 |
| 4,037,531 | 7/1977 | Ritzerfeld | 101/91 |
| 4,085,670 | 4/1978 | Poole | 101/76 |
| 4,262,590 | 4/1981 | Bruckner | 101/76 |

FOREIGN PATENT DOCUMENTS

| | | | |
|---|---|---|---|
| 2114416 | 9/1972 | Fed. Rep. of Germany | 101/76 |
| 2657610 | 6/1978 | Fed. Rep. of Germany | 101/76 |
| 2046173 | 11/1980 | United Kingdom | 101/76 |

*Primary Examiner*—J. Reed Fisher

*Attorney, Agent, or Firm*—Sughrue, Mion, Zinn, Macpeak & Seas

[57] ABSTRACT

A number printing machine for use with an offset printing press in which, with only a single numbering device, both a present and a successive number printing operation in which a desired number is printed a desired number of times can be carried out. Either of the two printing modes of operation can be selected by one action. A counter is provided which counts the number of times of printing of a number up to a value set on a dial unit. Once the preset value has been reached, a solenoid is actuated in response to which the number to be printed is changed to the next succeeding number.

5 Claims, 3 Drawing Figures

NUMBER PRINTING MACHINE FOR OFFSET PRESS

BACKGROUND OF THE INVENTION

The present invention relates to a number printing machine for an offset press.

A variety of number printing machines have been employed. For number printing operations in which, after one number has been printed several times, the next number is printed, it has been the practice to use a different numbering device when a present number is to be replaced by the next number. Accordingly, whenever a number to be printed is changed, the present numbering device must be replaced by another numbering device or it must otherwise be adjusted so that the next number can be printed. Therefore, it is essential but troublesome for the operator to manually intervene in the printing operations to replace the numbering devices. This system is also not economical in that it is necessary to provide many different numbering devices to be ready for use.

SUMMARY OF THE INVENTION

With a view of overcoming the foregoing drawbacks, the invention provides a number printing machine in which with only one numbering device, both a present and a successive number printing operation in which a desired number is printed a desired number of times can be carried out, and any one of the two printing operation can be selected in one action.

More specifically, the invention provides a number printing machine for an offset printing press including a transfer drum rotatably mounted on a shaft, a number printing impression cylinder and a numbering-device mounting drum mounted on a shaft disposed between an impression cylinder and a sheet delivery section in that order. The numbering machine includes a photoelectric device disposed at a predetermined position with respect to the transfer drum which is adapted to detect the presence of a printing sheet. A first switch is operated by the photoelectric device so as to energize a first solenoid. An impression cylinder actuation mechanism and a first cam adapted to rock the impression cylinder actuation mechanism are secured to the shaft of the transfer drum and the first solenoid is adapted to latch the actuation mechanism upon actuation of the first solenoid to thereby cause the number printing impression cylinder to approach the numbering-device mounting drum. A counter is provided having a timing input cam. A second switch operated by the first switch and the timing input cam produces pulses which are counted by the counter. A second cam is secured to the shaft of the numbering-device mounting drum and a timing mechanism is disposed to be rocked by the second cam with the second cam and timing input cam being fixedly secured to the shaft of the numbering-device mounting drum. A numbering cam is operated in association with the timing mechanism. A counter output contact is closed to energize a second solenoid to latch the timing mechanism to cause the numbering cam to be positioned such that the numbering cam is in contact with the cam follower of a numbering device so that a present number is replaced by a next succeeding number when the counter value of the counter coincides with a value set on a dial unit. With this structure, a successive number printing operation and a same number printing operation are selectively carried out by changing a value set on the dial unit.

DESCRIPTION OF THE PREFERRED EMBODIMENTS

Figure 1:
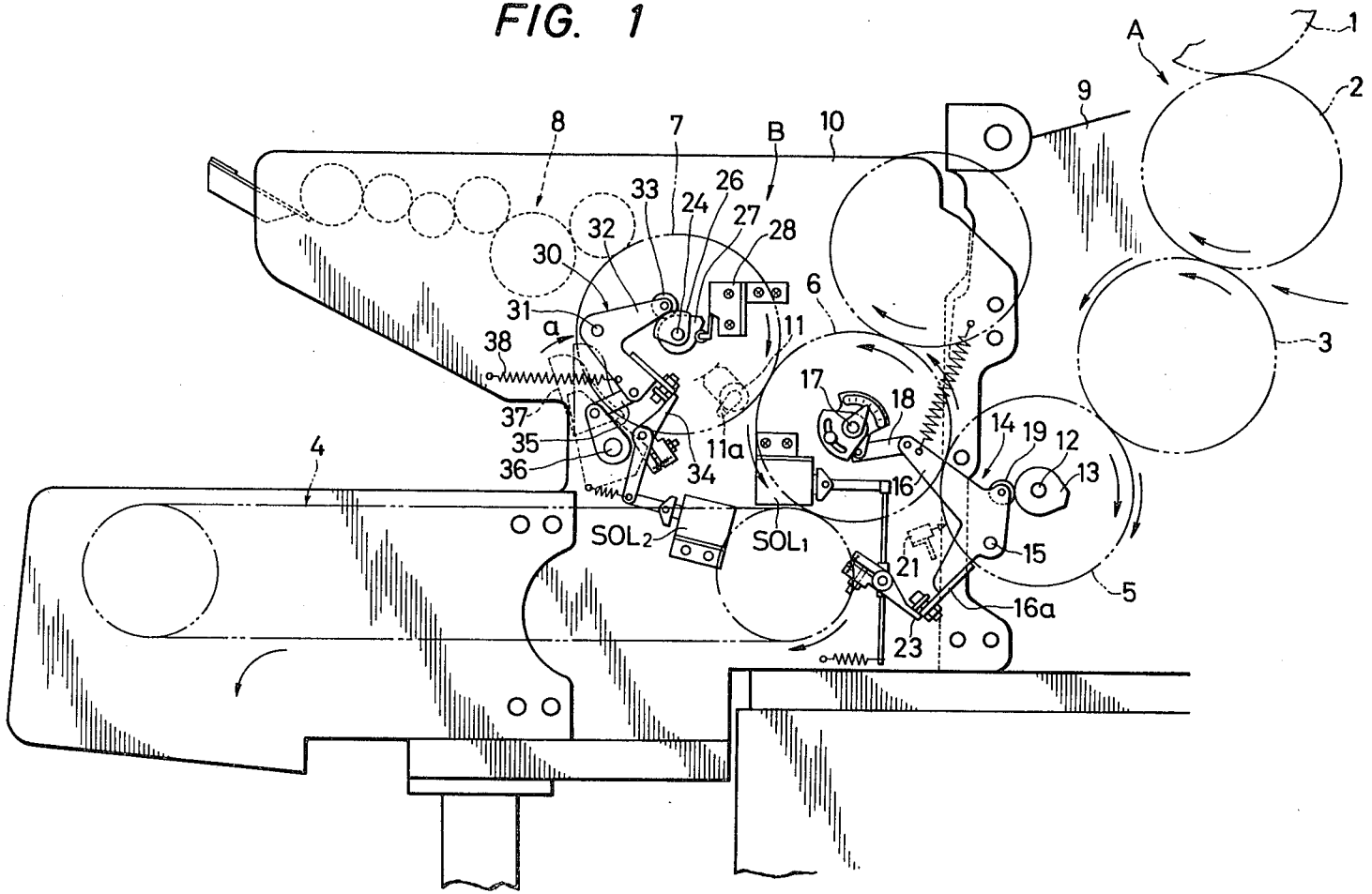
FIG. 1 is a side view of a number printing machine for an offset press according to the invention showing also the arrangement of the cylinders of the offset press.

The invention will be described with reference to a preferred embodiment shown in the accompanying drawings. As shown in FIG. 1, a printing machine A includes a plate cylinder 1, a blanket cylinder 2, an impression cylinder 3, an ink section (not shown), a water section (not shown), a sheet supply section, and a sheet delivery section 4. Generally, the printing machine A is arranged similarly to a conventional offset press.

A number printing machine B includes a transfer drum 5, a number printing impression cylinder 6, and a numbering-device mounting drum 7 and an ink supply section 8 which are disposed in the stated order between the plate cylinder 3 and the delivery section 4.

The transfer drum 5 is rotatably supported by frames 9 and is provided with a gripper section (not shown) to receive from the plate cylinder 3 a sheet printed by the printing machine A. The transfer drum 5 transfers the sheet to the number printing impression cylinder 6 with its printed surface to the outside. The number printing impression cylinder 6 serves as a platen for printing a number on the printing surface of a printing sheet and in forming vertical perforations or lateral perforations in the printing sheet. The cylinder 6 is provided with steel strips (not shown).

The numbering-device mounting drum 7 is rotatably supported by frames 10 and fixedly secures a numbering device 11.

The number printing impression cylinder 6 is rotatably supported through an eccentric shaft 17 on the frames 10. The number printing impression cylinder 6 is, normally, rotated while being moved alternately into and out of engagement with the numbering device mounting drum 7 by an impression cylinder actuation mechanism 14 which is rocked by a cam 13 fixedly secured to the shaft 12 of the transfer drum 5.

The impression cylinder actuation mechanism 14 includes an arm 16 which is pivotally mounted on a rod 15 on the frame 9. One end portion of the arm 16 is coupled through a link 18 to the shaft 17 of the number printing impression cylinder 6. The arm 16 has a roller 19 which is in contact with the cam 13 at all times. With this arrangement, the impression cylinder actuation mechanism 14 operates the number printing impression cylinder 6 as described above as the arm 16 is rocked by the arm 13 through the roller 19.

Figure 2:
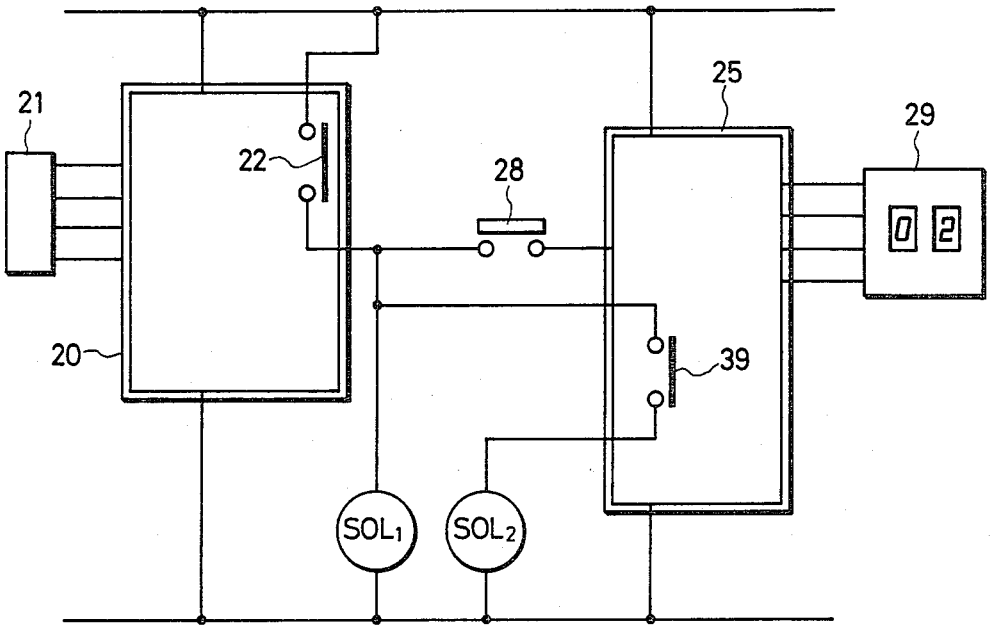
FIG. 2 is a circuit diagram showing an electrical control circuit of the number printing machine.

The sensor 21 of a photoelectric device 20 shown in FIG. 2 is provided at a suitable position with respect to the transfer drum 5. When the sensor 21 detects the presence of a printed sheet, a switch 22 is closed to energize a solenoid $SOL_1$ thereby to operate a latch 23. As a result, the latch 23 catches the other end portion 16*a* of the arm 16 so that it latches the impression cylinder actuation mechanism 14 wherein the number printing impression cylinder 6 is brought into contact with the numbering device mounting drum 7 and a number is printed on the sheet passing between the impression cylinder 6 and the drum 7.

Fixedly secured to the shaft of the numbering device mounting drum 7 are a timing input cam 26 of a counter 25 shown in FIG. 2 and a cam 27 for operating a timing mechanism described later. A switch 28 operated by the above-described switch 22 and the timing input cam 26 is fixedly secured to the frame 10. Whenever the switch 28 is operated, a pulse of a count signal is generated. The count pulses thus generated are applied to the counter 25 which counts them. The counter 25 is coupled to a dial unit 29.

The aforementioned timing mechanism 30 is provided on the frame 10 in such a manner as to be rocked by the cam 27. In the timing mechanism 30, an arm 32 is pivotally mounted on a rod 31 on the frame 10, and a roller 33 is rotatably coupled to one end portion of the arm 32 and is maintained in contact with the cam 27 by a spring 38. The other end portion of the arm 32 is positioned to be caught by a latch 34 which is operated by a solenoid $SOL_2$. The other end portion of the arm 32 is coupled through a link 35 to a numbering cam 37 which is fixedly secured to a rod 36. Thus, in the timing mechanism, the arm 32 is rocked upon rotation of the cam 27 so as to operate the numbering cam 37.

When the count value of the counter 25 coincides with a value set in the dial unit 29, a counter output contact 39 of the counter 25 is closed thereby energizing the solenoid $SOL_2$. As a result, the timing mechanism 30 operated by the cam 27 is latched. Accordingly, the numbering cam 37, being operated through the link 35, is moved in the direction of the arrow a in FIG. 1 to a position indicated by the two-dot chain line in contact with the cam follower 11*a* of the numbering device 11. As a result, the present number is replaced by the next succeeding number.

The output contact 39 in FIG. 2 is so designed that it is maintained closed for a predetermined period of time and, upon lapse of the predetermined period of time, it is opened thereby resetting the content of the counter 25.

In the printing machine thus constructed, when a printed sheet arrives at the transfer drum 5, it is detected by the sensor 21. As a result, the switch 22 is closed to energize the solenoid $SOL_1$. Accordingly, the impression cylinder actuation mechanism 14, operated by the cam 13, is latched and the number printing impression cylinder 6 is brought into contact with the drum 7 as a result of which a number is printed on the sheet passing between the impression cylinder 6 and the drum 7.

The count signal is applied to the counter 25 by the switch 28 which is operated by the switch 22 and the timing input cam 26 and the pulses of the count signal are counted by the counter 25.

If the same number is to be printed a number of times, the number of times of printing the same number is set by the dial unit 29. When the count value of the counter 25 coincides with the number set with the dial unit 29, the counter output contact 39 is closed to energize the solenoid $SOL_2$. As a result, the timing mechanism 30, operated by the cam 27, is caught by the latch 34 so that the numbering cam 37, operated through the link 35, is moved to a position abutting the cam follower 11*a* of the numbering device 11. Accordingly, the numbering device 11 is moved by the numbering device mounting drum 7 so that the numbering cam 37 is brought into contact with the cam follower 11*a* whereby the present number in the numbering device 11 is replaced by the next number.

As is apparent from the above description, in the case where successive numbers are to be printed, the number "1" is set on the dial unit 29 of the counter 25. On the other hand, if the same number is to be printed a predetermined number of times, the same number will be printed the predetermined number of times by setting the number on the dial unit 29.

Figure 3:
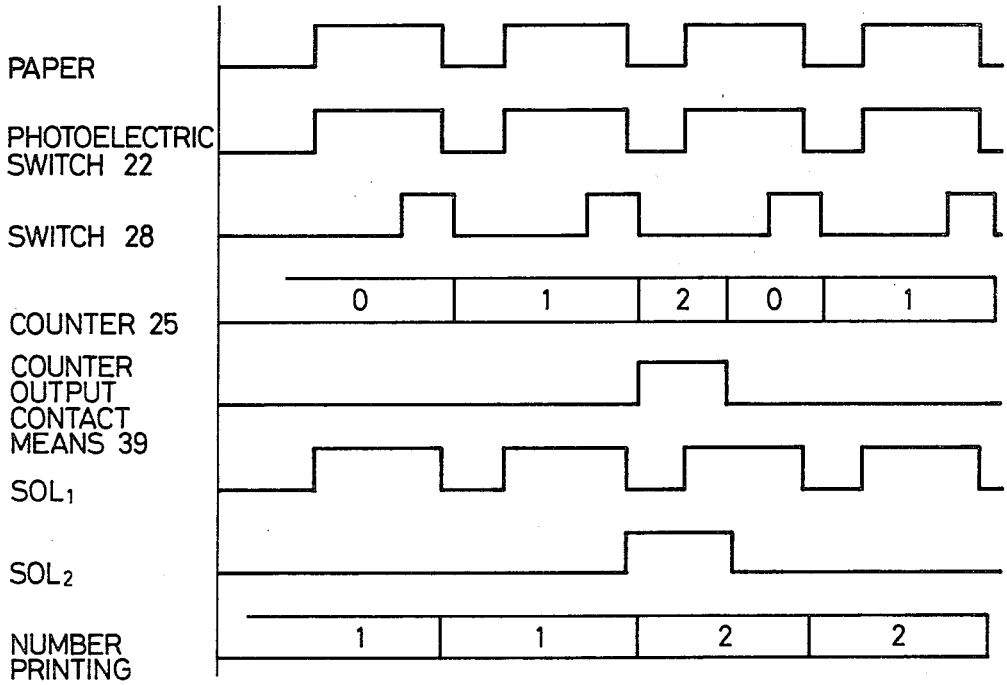
FIG. 3 is a timing chart illustrating a case where the same number is printed twice.

FIG. 3 is a timing chart illustrating the case where the same number is to be printed twice. In the number printing machine for an offset press according to the invention, as described above, the presence of a printing sheet is detected by a photoelectric device 20 in response to which the impression cylinder actuation mechanism 14 is operated by the solenoid $SOL_1$ so as to move the number printing impression cylinder 6 to the printing position where a number is printed on the sheet. The counter 25 counts the number of printing operations with the aid of the switch 28 which is operated by the switch 22 of the photoelectric device 20 and by the timing input cam 26 of the counter which is secured to the shaft 24 of the numbering device mounting drum 7. Thus, the predetermined number of printing operations can be continuously carried out. The timing mechanism 30, operated by the cam 27 fixedly secured to the shaft 24, is latched by the solenoid $SOL_2$ which is energized by the closure of the counter output contact 39 when the count value of the counter 25 coincides with a value set on the dial unit 29. As a result, the numbering cam 37 is moved into abutment against the cam follower 11*a* of the numbering device 11 so that the present number is replaced by the next succeeding number. Thus, the same number is printed the desired number of times.

With regard to the counter 25, upon closure of the switch 28, an input signal is applied to the counter 25 through the switch 28 so that addition of the applied input signal is effected by a counter circuit within the counter 25. When the input signal applied to the counter circuit is counted up to a numerical value set by the dial 29 (which may, for example, be a set of thumbwheel switches) a relay is activated thereby closing the output contact 39 of the counter output. Simultaneously with the closure of the contact 39, a timer circuit contained in the counter 25 is started. When the timer circuit reaches a preset time, the counter circuit is reset and the relay simultaneously deactivated. Correspondingly, the contact 39 is opened.

An example of such a counter is manufactured by Tateishi Denki Co., Ltd. as a model number H7A counter.

The counter 25 may also be constructed to operate in the following manner. The counter circuit is preset to a numerical value set on the dial 29 and is counted down in response to the input signal applied to the counter circuit through the switch 28. When the numerical value of the counter circuit reaches zero, the relay is activated thereby closing the contact 39. Simultaneously with the closure of the contact 39, the operation of the timer circuit is commenced. When the timer circuit reaches a preset time, the numerical value set on the dial 29 is again preset in the counter circuit and thereby deactivating the relay.

As is apparent from the above description, with the numbering device adapted to print successive numbers of the invention, not only can successive numbers be printed, but also the same number can be printed a desired number of times merely by setting the desired number of times on the dial unit 29. Thus, in the number printing machine of the invention, unlike the prior art devices, it is unnecessary to replace the numbering device or to adjust it, which contributes to an improvement of the efficiency of the number printing operation. Since it is unnecessary to provide a plurality of numbering devices, the number printing machine of the invention provides much improved economy. The successive number printing operations and the same number printing operations can be readily selected merely by changing a value set on the dial unit. Thus, the invention is considerably effective in practical use.

What is claimed is:

1. A number printing machine for an offset press comprising: a transfer drum rotatably mounted on a shaft, a number printing impression cylinder and a numbering-device mounting drum mounted on a shaft disposed between an impression cylinder and a sheet delivery section in the stated order; said numbering machine comprising: a photoelectric device disposed at a predetermined position with respect to said transfer drum, said photoelectric device being adapted to detect the presence of a printing sheet; a first solenoid; a first switch coupled to be operated by said photoelectric device thereby to energize said first solenoid; an impression cylinder actuation mechanism and a first cam adapted to rock said impression cylinder actuation mechanism fixedly secured to said shaft of said transfer drum, said first solenoid being adapted to latch said actuation mechanism upon actuation of said first solenoid to cause said number printing impression cylinder to approach said numbering-device mounting drum; a counter having a timing input cam; a second switch operated by said first switch and said timing input cam of a counter, said timing input cam being secured to said shaft of said numbering device mounting drum, said counter being adapted to count a count signal applied thereto through said second switch; a second cam secured to said shaft of said numbering-device mounting drum; a timing mechanism disposed to be rocked by said second cam, said second cam and said timing input cam being fixedly secured to said shaft of said numbering-device mounting drum; a numbering cam operated in association with said timing mechanism; a second solenoid; a numbering device having an input cam follower; a counter output contact which, when a count value of said counter coincides with a value set on a dial unit, is closed to energize said second solenoid, whereby said timing mechanism is latched to cause said numbering cam to be positioned such that said numbering cam is in contact with said cam follower of said numbering device so that a present number is replaced by a next succeeding number, wherein a successive number printing operation and a same number printing operation are selectively carried out by changing a value set on said dial unit.

2. The offset printing press of claim 1 wherein said number printing impression cylinder is rotatably supported on an eccentric shaft wherein said number printing impression cylinder while rotated is moved alternately in and out of engagement with said numbering-device mounting drum by said impression cylinder actuation mechanism.

3. The number printing machine of claim 1 wherein said impression cylinder actuation mechanism comprises an arm pivotally mounted on a rod on a frame member, a roller being provided on one end of said arm and another end portion of said arm being coupled through a link to said shaft of said number printing impression cylinder, said roller being maintained in contact with said first cam.

4. The number printing machine of claim 1 wherein said timing mechanism comprises an arm pivotally mounted on a rod on a frame member, a roller provided at one end of said arm, a spring for maintaining said roller in contact with said second cam, and one end portion of said arm being adapted to be caught by a latch member of said second solenoid.

5. The number printing machine of claim 4 wherein one end portion of said arm is coupled through a link to said numbering cam.

* * * * *